US005517395A

United States Patent [19]

Weissman

[11] Patent Number: 5,517,395

[45] Date of Patent: May 14, 1996

[54] AERODYNAMIC TRAFFIC LIGHT COVER ASSEMBLY

[76] Inventor: Ira B. Weissman, 10146 SW. 93 Pl., Miami, Fla. 33176

[21] Appl. No.: 262,683

[22] Filed: Jun. 20, 1994

[51] Int. Cl.[6] ..... F21S 13/10

[52] U.S. Cl. ..... 362/363; 362/369; 362/376; 116/63 R

[58] Field of Search ..... 116/63 R; 340/907; 362/363, 376, 311, 267, 369, 390, 374

[56] References Cited

U.S. PATENT DOCUMENTS 2,733,334 1/1956 Cosgrove ..... 362/376

4,204,271 5/1980 Braly ..... 362/363

4,425,602 1/1984 Lansing ..... 362/363

*Primary Examiner*—Stephen F. Husar

*Attorney, Agent, or Firm*—Robert M. Downey

[57] ABSTRACT

A cover for attachment to a traffic light is provided including a transparent shell having an aerodynamically configured outer surface and a peripheral edge surrounding an interior of the cover, the peripheral edge including a seal thereabout to prevent moisture from entering the interior and accumulating on an inner surface of the cover when attached to the traffic light. Once attached, the cover provides an overall aerodynamic configuration to the combined traffic light and cover assembly while permitting visibility of the traffic signal lights through the transparent shell.

8 Claims, 1 Drawing Sheet

AERODYNAMIC TRAFFIC LIGHT COVER ASSEMBLY

BACKGROUND OF THE INVENTION

1. Field of the Invention

The present invention relates to an aerodynamic cover, and particularly to a transparent cover adapted for air tight attachment to a traffic light assembly such that when attached, the cover provides an aerodynamic configuration to the traffic light assembly while permitting visibility of the traffic light signals.

2. Background of the Invention

The external configuration of traffic light housing includes multiple flat surfaces, as well as extending structures such as visors above the signal lights and in some instances side blinders. While some of these external structural features serve a significant function, such as reducing glare on the signal light lens, they render the traffic light assembly inherently unstable in heavy wind conditions. For this reason, it is not uncommon for traffic lights to be detached, twisted or disoriented from their proper supported position on power lines or posts when exposed to high winds such as during a tropical storm or hurricane. Particularly after a hurricane, a city or municipality may loose 50% or more of the area's traffic lights. In a densely populated area it can take several years to repair and replace traffic lights that were lost in such devastating storms.

Accordingly, there is a need for a means of reducing the wind resistance of traffic light assemblies to make them more aerodynamic in order to withstand higher wind speeds, generally in access of 50 mph, as experienced during tropical storms and hurricanes.

SUMMARY OF THE INVENTION

The present invention is directed to a cover assembly for attachment to a traffic light in order to provide an overall aerodynamic configuration to the combined traffic light and cover assembly. The cover assembly includes a transparent shell which, in a preferred embodiment, is comprised of two halves each having an aerodynamically configured outer surface and a peripheral edge surrounding an interior of the shell half. Each shell half includes a seal about the respective peripheral edge. Attachment means, such as clamps, hinges or other means facilitate attachment of the shell halves in covering relation to the traffic light housing with the seals on the corresponding peripheral edges disposed in mating, sealed engagement so as to prevent moisture from entering the interior of the cover once the shell halves are attached. In this manner, at least a portion of the traffic light assembly is encapsulated in airtight, sealed engagement within the cover assembly without obstructing the normal visibility the traffic signal lights through the transparent shell.

The cover assembly may further be provided with stabilizing means for securing the shell to the traffic light housing in such a matter as to prevent movement of the shell structure relative to the traffic light housing when attached thereto. The stabilizing means, as well as the seals, may be further structured to provide shock absorbing characteristics to absorb shock from the impact of flying objects which may strike the external surface of the cover assembly in heavy wind conditions.

Accordingly, with the forgoing in mind, it is a primary object of the present invention to provide a transparent cover assembly for traffic lights which is specifically designed to provide an aerodynamic configuration to the traffic light when attached thereto, thereby reducing wind resistance and increasing the stability of the traffic light in high wind conditions.

It is a further object of the present invention to provide an aerodynamic cover assembly for attachment to traffic lights which will not substantially interfere with or reduce the normal visibility of the traffic light signals.

It is still a further object of the present invention to provide an aerodynamic, transparent cover assembly for attachment to traffic lights, in at least partially covering relation to the traffic light housing, so as to impart an aerodynamic configuration to the traffic light housing.

It is yet another object of the present invention to provide an aerodynamic, transparent cover assembly for attachment to a traffic light assembly in sealed, covering relation to at least a portion of the traffic light housing and including seal means prevent moisture from entering the cover once attached to the traffic light.

It is still a further object of the present invention to provide an aerodynamic, transparent cover assembly for attachment to a traffic light assembly, the cover assembly including means to stabilize the attachment so as to prevent movement of the cover assembly relative to the traffic light assembly.

It is yet a further object of the present invention to provide an aerodynamically configured, transparent cover assembly for attachment to a traffic light assembly, the cover assembly including means to absorb shock from impact of external objects which may strike the cover assembly in high wind conditions.

These and other objects of the present invention will be more readily apparent in the description which follows.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENTS

Figure 1:
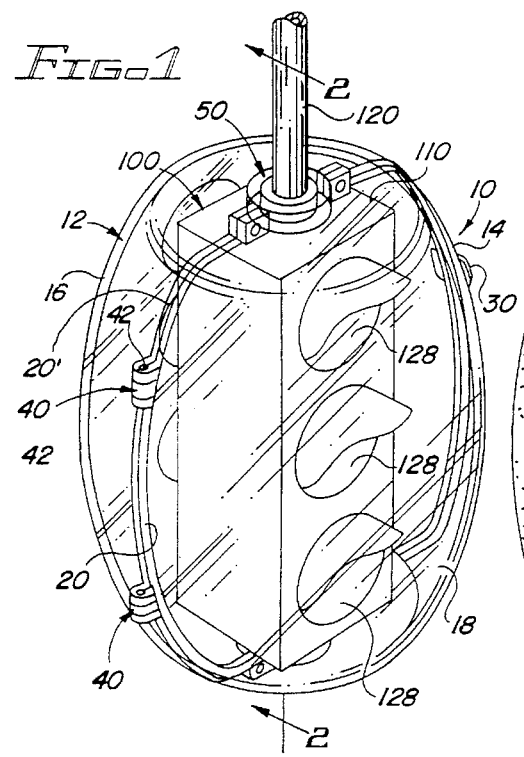
FIG. 1 is a perspective view of the transparent cover assembly of the present invention shown attached to a traffic light assembly in substantially covering relation to the traffic light housing.
Figure 2:
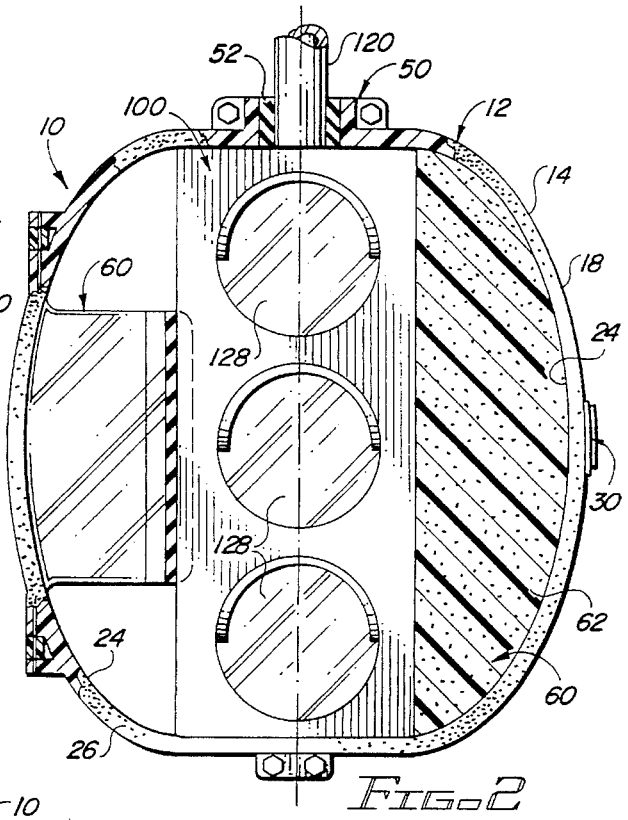
FIG. 2 is a front elevation, in partial section, taken along the line 2—2 of FIG. 1.
Figure 3:
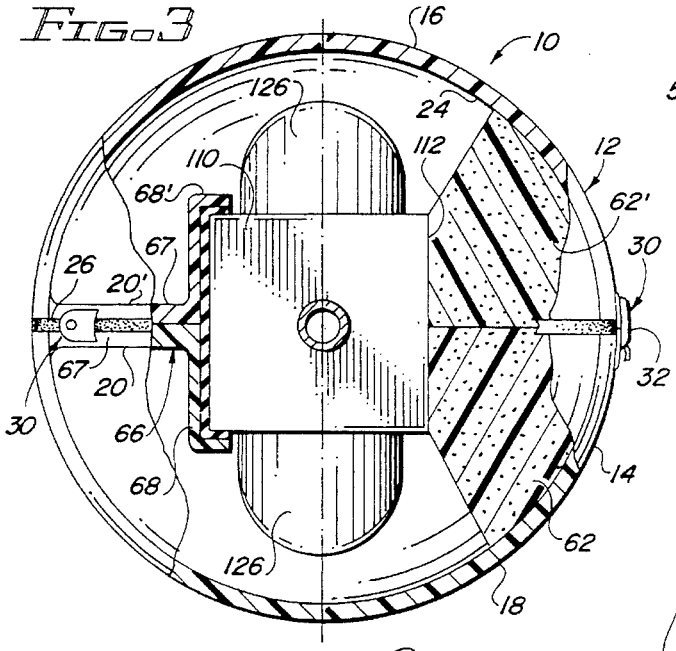
FIG. 3 is a top plan view, in partial section of the embodiment of FIG. 2.

Referring to the several views of the drawings, there is generally illustrated the cover assembly 10 of the present invention which is adapted for attachment to a traffic light assembly 100 of the type including a traffic light housing 110. The cover assembly 10 includes a shell structure 12 formed of a transparent, anti-fogging material such as thermal plastic or a poly carbonate composition. In a preferred embodiment, the shell 12 includes two halves including a first half 14 and a second half 16. Each of the halves 14, 16 includes an outer, generally convex surface 18 providing an external aerodynamic configuration, and a respective peripheral edge 20, 20' disposed in surrounding relation to an interior of the shell half 14, 16, defined by a volume of space created by a generally concave inner surface 24 of each shell half 14, 16. The respective peripheral edges 20, 20' are specifically structured and disposed to be in opposing relation for mating engagement with one another when the shell halves are attached, thereby enclosing the interiors thereof to define a sealed chamber within which at least a portion of the traffic light housing 110 is captivated.

At least one of the peripheral edges 20, 20' includes a seal 26 thereabout such that when the two shell halves 14, 16 are attached about the corresponding, opposing peripheral edges 20, 20', moisture is prevented from entering the interior of the cover assembly 12, thereby preventing fogging of the transparent shell structure. The seal, on either one or both of the peripheral edges 20, 20' may be provided with a flat surface. Alternatively, opposing seals on the respective peripheral edges 20, 20' may be specifically structured to interlock with one another to provide an airtight, watertight seal. For instance, the opposing seals may be structured to have a tongue and groove configuration for interlocking engagement when the two shell halves 14, 16 are closed.

In order to maintain the shell halves 14, 16 in closed, sealed engagement, securing means 30 are provided. The securing means 30 may be of any suitable structure adapted for maintaining the shell halves in closed, sealed engagement. In a preferred embodiment, one or several clamps 32 may be provided, each of the clamps including a hinged lock clasp 34 fixed to one of the shell halves adjacent the respective peripheral edge 20' and adapted for locking engagement with a catch 36 fixed to the other shell half 14 adjacent the opposing peripheral edge 20. Clamps 32 of this type, or the structural equivalent may be provided at various locations about the mating peripheral edges 20, 20'. Additionally, hinge means 40, including one or a plurality of hinges 42 may be used in combination with the clamps 32 to maintain the shell halves 14, 16 interconnected, while permitting opening an closing of the shell halves for attachment and removal to the traffic light assembly 100.

Figure 4:
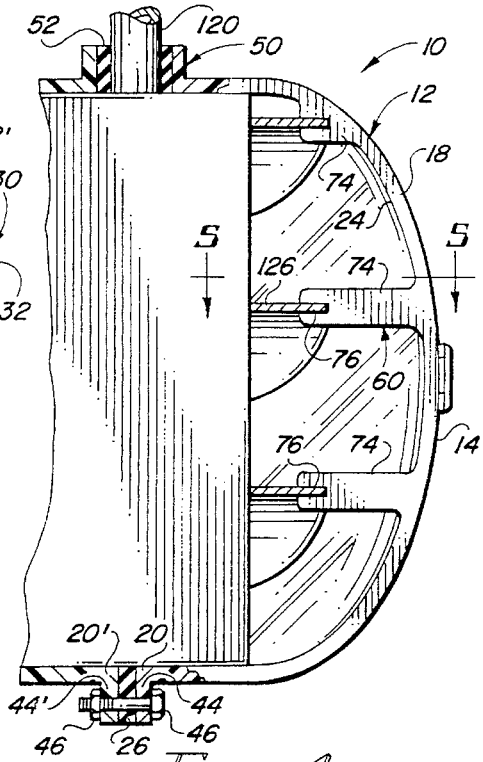
FIG. 4 is a side elevation, in partial section of an alternative embodiment.
Figure 5:
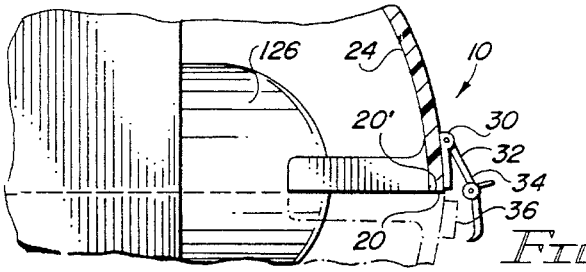
FIG. 5 is an isolated view, in partial section taken along the line 5—5 of FIG. 4.

Other securing means 30 may include mating flanges 44, 44' disposed in opposing relation about the corresponding peripheral edges 20, 20', as best illustrated in FIG. 4. In this instance, the seal 26 specifically configured to extend between the flanges 44, 44' in sandwich relation therebetween. One or a plurality of bolt and nut fasteners 46 secure the opposing flanges 44, 44' in compressed engagement with the seal 26. Further, an annular collar 50 may be provided at the top or bottom of the cover assembly 10, defined by opposing collar halves formed on the respective peripheral edges 20, 20' and specifically structured to be fitted about a support structure 120 of the traffic light assembly 100. To maintain a moisture tight attachment, a ring seal 52 is fitted within the collar 50 for sealed engagement between the support structure 120 and the collar 50.

In order to prevent movement of the shell structure 10 relative to the traffic light housing 110, stabilizing means 60 may be provided within the shell structure. In one embodiment, the stabilizing means may include one or several foam pads 62, 62' attached to the inner surface 24 of the shell structure 12 and structured and configured to engage at least one side 112 of the traffic light housing 110. In addition to preventing substantial movement of the shell structure 12 relative to the traffic light housing 110, the foam pads 62, 62' absorb shock which may be imparted to the shell structure 12 exerted by a flying object which might strike the exterior of the shell structure 12 in high wind conditions.

In an alternative embodiment, the stabilizing means 60 may also include a light housing grasping structure 66 structured to grasp the traffic light housing 110. In one embodiment the grasping structure 66 includes webs 67, 67' having corresponding grasping members 68, 68' adapted to conform with and substantially grasp at least one side 114 of the traffic light housing 110. A rubber shock pad 69 may be provided between the grasp members 68, 68' to absorb shock imparted by an object striking the shell structure 12.

Still a further embodiment of the stabilizing means 60 includes grasping fingers 74 integrally formed with the inner surface 24 of the shell structure 12 and extending inwardly for engagement with the light signal visors 126 of the traffic light housing 110. The fingers 74 each include a slot 76 formed in their distal ends for receiving an edge of a respective visor 126 therein. Shock absorbing pads may further be provided within the slots 76 to absorb impact exerted by an object striking the shell structure 12. As best seen in FIG. 1, the cover assembly 10, once attached to the traffic light assembly 100, provides an overall aerodynamic configuration to the combined assembly while maintaining full, unobstructed normal visibility of the traffic light signals 128 through the transparent shell structure 12.

While this invention has been shown and described in what is believed to be preferred embodiments, it is recognized that departures may be made within the spirit and scope of the invention which should not therefore be limited except by the following claims and within the Doctrine of Equivalents.

Now that the invention has been described,

What is claimed is:

1. An assembly for use in combination with a traffic light, the traffic light including a housing with a top, a bottom and at least one main face having at least one light signal thereon said assembly comprising:

a base defining a cover and including a transparent shell having an outer aerodynamically configured surface and at least one peripheral edge surrounding an interior of said cover, securing means for securing said cover to the traffic light in covering relation to at least a portion of the traffic light housing so that said light signal is visible through said transparent shell, seal means on said peripheral edge for preventing moisture form entering said interior of said cover when secured to the traffic light, and said cover providing an exterior aerodynamic configuration to the traffic light housing when said cover is secured to the traffic light.

2. An assembly as recited in claim 1 further including stabilizing means for preventing movement of said cover relative to said traffic light housing wherein attached to said traffic light.

3. An assembly as recited in claim 2 wherein said shell includes two portions including a first portion and a second portion, each of said first and second portions including correspondingly opposed peripheral edges adapted for mating, sealed engagement with one another when said cover is secured to the traffic light.

4. An assembly as recited in claim 1 wherein said securing means includes clamp means.

5. An assembly as recited in claim 3 herein said securing means includes clamp means structured and disposed for clamping said first and second portions of said cover together along said corresponding opposed peripheral edges, with said opposed peripheral edges disposed in mating, sealed engagement.

6. An assembly as recited in claim 5 wherein said securing means further includes hinge means hingedly attaching said first and second portions of said cover along a portion of said correspondingly peripheral edges.

7. An assembly as recited in claim 6 wherein said means to prevent relative movement includes attachment means on said cover structured and disposed for attachment of said cover to said traffic light housing.

8. An assembly as recited in claim 7 wherein said attachment means includes an annular collar formed between said correspondingly opposed peripheral edges, said annular collar being structured and disposed for attached engagement with said traffic light.

* * * * *